US007062212B2

(12) United States Patent
Naruse et al.

(10) Patent No.: US 7,062,212 B2
(45) Date of Patent: Jun. 13, 2006

(54) CLEANING APPARATUS, IMAGE FORMING APPARATUS, AND PROCESS CARTRIDGE

(75) Inventors: Osamu Naruse, Kanagawa (JP); Tohru Nakano, Kanagawa (JP); Masanori Horike, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/825,318

(22) Filed: Apr. 16, 2004

(65) Prior Publication Data

US 2004/0265024 A1 Dec. 30, 2004

(30) Foreign Application Priority Data

Apr. 17, 2003 (JP) ..... 2003-113506

(51) Int. Cl.
*G03G 21/00* (2006.01)

(52) U.S. Cl. ..... 399/350; 399/123; 399/351

(58) Field of Classification Search ..... 399/111, 399/343, 344, 350, 351, 123, 346; 15/1.51, 15/256.5, 256.51, 256.52, 256.53; 430/58.05, 430/11.4

See application file for complete search history.

(56) References Cited

U.S. PATENT DOCUMENTS

| | | | |
|---|---|---|---|
| 4,173,402 | A | 11/1979 | Horike et al. |
| 4,178,595 | A | 12/1979 | Jinnai et al. |
| 4,217,595 | A | 8/1980 | Horike et al. |
| 4,228,440 | A | 10/1980 | Horike et al. |
| 4,231,047 | A | 10/1980 | Iwasaki et al. |
| 4,231,048 | A | 10/1980 | Horike et al. |
| 4,281,332 | A | 7/1981 | Horike |
| 4,286,273 | A | 8/1981 | Horike |
| 4,288,797 | A | 9/1981 | Horike et al. |
| 4,293,865 | A | 10/1981 | Jinnai et al. |
| 4,310,846 | A | 1/1982 | Horike |
| 4,313,123 | A | 1/1982 | Jinnai et al. |
| 4,364,051 | A | 12/1982 | Yamashita |
| 4,364,060 | A | 12/1982 | Jinnai et al. |
| 4,365,255 | A | 12/1982 | Horike et al. |
| 4,370,664 | A | 1/1983 | Horike et al. |
| 4,393,385 | A | 7/1983 | Jinnai et al. |
| 4,395,717 | A | 7/1983 | Horike et al. |
| 4,400,705 | A | 8/1983 | Horike |
| 4,418,352 | A | 11/1983 | Horike et al. |
| 4,426,652 | A | 1/1984 | Horike et al. |
| 4,429,317 | A | 1/1984 | Umezawa et al. |
| 4,434,428 | A | 2/1984 | Horike et al. |
| 4,435,720 | A | 3/1984 | Horike et al. |
| 4,437,101 | A | 3/1984 | Ebi et al. |
| 4,502,055 | A | 2/1985 | Horike et al. |
| 4,504,844 | A | 3/1985 | Ebi et al. |
| 4,510,509 | A | 4/1985 | Horike et al. |
| 4,520,367 | A | 5/1985 | Ishikawa et al. |
| 4,535,339 | A | 8/1985 | Horike et al. |
| 4,550,321 | A | 10/1985 | Sato et al. |
| 4,558,995 | A | 12/1985 | Furukawa et al. |

(Continued)

FOREIGN PATENT DOCUMENTS

| | | |
|---|---|---|
| JP | 9-325659 | 12/1997 |

(Continued)

*Primary Examiner*—Hoan Tran
(74) *Attorney, Agent, or Firm*—Oblon, Spivak, McClelland, Maier & Neustadt, P.C.

(57) ABSTRACT

A cleaning apparatus is disclosed that includes a blade chip having a rubber plate member and a reinforcing plate member that are joined together, a supporting plate supporting the blade chip, and a holder pressing the blade chip against the supporting plate.

19 Claims, 8 Drawing Sheets

U.S. PATENT DOCUMENTS 4,562,442 A 12/1985 Jinnai et al.
4,626,867 A 12/1986 Furukawa et al.
4,677,845 A 7/1987 Izumi et al.
4,800,398 A 1/1989 Naruse et al.
4,834,533 A 5/1989 Horike et al.
4,847,631 A 7/1989 Naruse et al.
5,146,236 A 9/1992 Hirata et al.
5,153,657 A * 10/1992 Yu et al. ..... 399/350
5,260,723 A 11/1993 Naruse et al.
5,270,740 A 12/1993 Naruse et al.
5,412,413 A 5/1995 Sekiya et al.
5,600,356 A 2/1997 Sekiya et al.
5,818,482 A 10/1998 Ohta et al.
5,835,837 A * 11/1998 Saitoh et al. ..... 399/343
5,999,773 A * 12/1999 Yasutomi et al. ..... 399/148
6,115,576 A 9/2000 Nakano et al.
6,438,327 B1 * 8/2002 Kimizuka et al. ..... 399/12
6,611,672 B1 8/2003 Aoki et al.
6,640,073 B1 10/2003 Kurotori et al.
6,694,122 B1 * 2/2004 Muto et al. ..... 399/350
6,701,123 B1 * 3/2004 Endo et al. ..... 399/350
6,708,014 B1 3/2004 Miyaguchi et al.
6,721,523 B1 4/2004 Sugiura et al.
6,735,408 B1 5/2004 Yoshino et al.
6,738,592 B1 5/2004 Sasaki et al.
6,957,028 B1 * 10/2005 Serizawa et al. ..... 399/148
2002/0192000 A1 12/2002 Yusui et al.

FOREIGN PATENT DOCUMENTS

JP 11-30938 2/1999
JP 11-174992 7/1999
JP 11-219082 8/1999
JP 2961926 8/1999
JP 2000-259051 9/2000

* cited by examiner

CLEANING APPARATUS, IMAGE FORMING APPARATUS, AND PROCESS CARTRIDGE

BACKGROUND OF THE INVENTION

1. Field of the Invention

This invention relates to an image forming apparatus using an electrophotographic method or an electrostatic recording method, for example, a copier, a printer, or a facsimile, and more particularly, to an image forming apparatus having a cleaning apparatus.

2. Description of the Related Art

Along with growth of the information society, there is a growing demand for an image forming apparatus (e.g. electrophotographic copier, electrophotographic printer) which forms images with higher speed, which requires less space, which generates high quality images, and which has an extensive longevity. Along with this growing demand, there is a demand for an electrophotographic image carrier used for an image forming apparatus which responds at high speed, which has a small size, and which provides high endurance. Accordingly, an image carrier applied with amorphous-Si, or an organic image carrier having an organic coat layer added with an inorganic material, for example, have been proposed for increasing longevity of the image carrier.

Since a cleaning apparatus is liable to damage the image carrier, a cleaning apparatus using a brush cleaning technique that allows toner remaining on the image carrier to be removed by electrostatic force has been proposed in order to prevent damage to the image carrier. However, the cleaning apparatus using the electrostatic method is unable to clean sufficiently since the cleaning apparatus relies on the polarity of the toner after transfer, and is largely influenced by environmental factors such as temperature and humidity. Accordingly, image quality cannot be improved with this method.

In addition, a higher image quality can be obtained the more the diameter of toner particles is reduced, and the more the shape of the toner particles becomes a sphere. Therefore, development and the market are directed toward providing toner particles with smaller diameters and with shapes closer to a sphere. Nevertheless, as the diameters of the toner particles become smaller and as the shapes of the toner particles become closer to a sphere, cleaning tends to become more difficult. More specifically, after a toner image is transferred to a target transfer body, it is difficult to sufficiently remove toner remaining on the surface of the image carrier, and thereby results in poor cleaning performance. Since toner, being situated at a contacting part between the image carrier and the cleaning blade, is more or less near a closest packed state during cleaning with a blade cleaning method, a first layer of toner, which is situated toward the image carrier side and which firmly adheres to the image carrier, slides against a second layer of toner situated above the first layer of toner, thereby causing the toner of the first layer to remain on the image carrier and resulting in poor cleaning performance.

In order to solve the foregoing problems, measures are taken for the cleaning blade method, for example, by increasing the degree of hardness of rubber and contact pressure of the blade. These, however, promote the wear of the image carrier and accelerate the wear of the rubber of the blade, thereby shortening the longevity of the cleaning blade.

Therefore, the cleaning blade is, for example, CVD (Chemical Vapor Deposition) coated with a film made of at least one kind of resin among a group comprising a styrene-based resin, an acryl-based resin, and an ethylene-based resin, as shown in Japanese Laid-Open Patent Application No. 2000-259051. By employing this technique of applying the CVD process to the cleaning blade, hydrolytic cleavage can be prevented, and the friction coefficient can be reduced.

As another example, in order to simplify assembly, Japanese Patent Registration No. 02961926 shows a cleaning blade having an elastic member disposed between a rubber plane fixing member for fixing a planar rubber member and a fixing member for fixing the entire cleaning blade. As another example, in Japanese Laid-Open Patent Application No. 9-325659, attachment holes and protruding parts are formed in a row-like arrangement, are engaged with each other, and are adhered to each other with an adhesive member.

As another example, Japanese Laid-Open Patent Application No. 11-219082 shows a cleaning blade having a layer structure, in which a resin layer is disposed on a metal plane.

As another example, Japanese Laid-Open Patent Application No. 11-30938 shows a cleaning apparatus having a cleaning blade including a free-end for cleaning the surface of the image carrier and a fixed-end for defining the position of a cleaning part during cleaning, and an ultra-sonic cleaning support device, disposed on the fixed-end of the cleaning blade, for floating off and removing the particles on the image carrier surface by applying vibration energy to the cleaning blade. With this example, vibration energy of a vibrator is concentrated toward the tip-end of the blade contacting the image carrier surface so that toner particles remaining on the image carrier surface may be floated off and prevented from adhering to the image carrier, therefore, enabling the cleaning blade to efficiently remove the floated off toner particles and provide a better cleaning performance.

As another example, Japanese Laid-Open Patent Application No. 11-174992 shows a cleaning blade provided with piezoelectric elements for applying vibration thereto, so that problems, for example, toner fusing upon the image carrier surface, abnormal noise, abnormal vibration, and peeling of the blade can be prevented from occurring.

A conventional cleaning process employing a cleaning blade for cleaning remaining toner faces problems such as turning over of the cleaning blade, generation of abnormal noise, and accelerated wear of the cleaning blade. Furthermore, the conventional cleaning process faces a problem of a filming phenomenon in which the blade member and the image carrier rubbing against each other causes resin material of toner to adhere to the surface of the image carrier. This results in degrading of image quality.

Furthermore, a cleaning method of applying vibrations to a cleaning blade is proposed in response to toners that are formed in smaller sizes and with more roundness. This method, however, faces a problem of wearing of the cleaning blade at a portion that rubs against the image carrier. Since the cleaning blade has less hardness than the image carrier, the cleaning blade wears faster than the image carrier, and has a shorter longevity than the image carrier.

In replacing a worn cleaning blade, the cleaning blade alone cannot be replaced, but needs to be replaced as a unit including, for example, a supporting member attached (adhered) to the cleaning blade.

That is, as in Japanese Patent Registration No. 02961926, since the components of the cleaning apparatus are all adhered to each other with an adhesive agent, the unit for replacing a worn cleaning blade would include other components adhered to the cleaning blade, to thereby increase cost. Furthermore, the example shown in Japanese Laid- Open Patent Application No. 9-325659, which has a plate spring member serving as an elastic member, is also unable to reduce cost, since the unit for replacing a worn cleaning would include the plate spring member.

Furthermore, in a case where a piezoelectric element, serving as a vibration source, is provided to the cleaning blade, the replacement of the cleaning blade requires further cost due to the additional cost of replacing the piezoelectric element. Particularly, when the piezoelectric element is still able to be used, the replacement of the cleaning blade is wasteful.

Meanwhile, in the example shown in Japanese Laid-Open Patent Application No. 2000-259051, since resin is coated on the surface of the cleaning blade by using a CVD method, an adhering property (effect) of rubber itself is reduced, to thereby degrade cleaning performance. Furthermore, the example has a problem of lacking endurance since the rubbing between the cleaning blade and the image carrier causes the coating on the blade surface to peel off. Even when a small portion of coating is peeled off, the rubbing causes the peeling to further spread around the peeled off portion, to thereby aggravate the lack of endurance.

In the example shown in Japanese Laid-Open Patent Application No. 11-219082, the plate-like blade member lacks cohesiveness with respect to the image carrier since the blade member is of a resin material. This causes creation of a gap therebetween, and results in poor cleaning performance. Furthermore, since the image carrier itself is formed of a resin mainly composed of polycarbonate, problems such as damaging of the surface therebetween are caused.

In the example shown in Japanese Laid-Open Patent Application No. 11-219082, environmental conditions, particularly temperature, cause large changes in the propagation of acoustic waves since standing waves are formed in a waveguide for propagating ultrasonic waves. This causes difficulty in obtaining a steady vibration. Furthermore, this example requires a considerably large vibrator for uniformly forming standing waves in a width direction of the image carrier, therefore making size reduction of the apparatus difficult. Furthermore, this example mainly focuses on reducing the adherence between the image carrier and the remaining toner particles, and the apparatus which applies vibration is not assigned to perform cleaning, but is a supplementary unit employed for cleaning.

In the example shown in Japanese Laid-Open Patent Application No. 11-174992, the waveform of the vibration applied to the cleaning blade is a standing wave, and is formed in the longitudinal direction of the cleaning blade. Accordingly, with this structure, vibration tends to be changed by external conditions in the environment. Furthermore, efficiency in the propagation of vibration is extremely poor since the material of the cleaning blade is an elastic material. Furthermore, since the vibration is applied in a longitudinal direction of the cleaning blade, the propagation of vibration is absorbed, thereby resulting in poor vibration efficiency.

SUMMARY OF THE INVENTION

It is a general object of the present invention to provide a cleaning apparatus, an image forming apparatus, and a process cartridge that substantially obviate one or more of the problems caused by the limitations and disadvantages of the related art.

Features and advantages of the present invention are set forth in the description which follows, and in part will become apparent from the description and the accompanying drawings, or may be learned by practice of the invention according to the teachings provided in the description. Objects as well as other features and advantages of the present invention will be realized and attained by a cleaning apparatus, an image forming apparatus, and a process cartridge, particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides a cleaning apparatus including: a blade chip having a rubber plate member and a reinforcing plate member that are joined together; a supporting plate supporting the blade chip; and a holder pressing the blade chip against the supporting plate.

According to an embodiment of the present invention, the length between a distal end of the rubber plate member and a distal end of the reinforcing plate member may be no more than the thickness of the rubber plate member.

According to an embodiment of the present invention, at least a portion of the rubber plate member may be surface treated for reducing friction created thereon.

According to an embodiment of the present invention, the cleaning apparatus may further include a holding plate having a support axle for rotatably supporting the blade chip via the supporting plate.

Furthermore, the present invention provides an image forming apparatus including the cleaning apparatus.

Furthermore, the present invention provides a process cartridge having an image carrier on which an electrostatic latent image is formed, a charging unit for charging the image carrier to form the electrostatic latent image thereon, a developing unit for developing the electrostatic image with a developer, the process cartridge including: the cleaning apparatus.

According to an embodiment of the present invention, the image forming apparatus may include at least one process cartridge.

Furthermore, the present invention provides a cleaning apparatus including: a blade chip having a rubber plate member and a reinforcing plate member that are joined together; a vibration plate supporting the blade chip; a piezoelectric element disposed on the vibration plate for propagating vibration to the blade chip via the vibration plate; and a holder pressing the blade chip against the vibration plate.

According to an embodiment of the present invention, the cleaning apparatus may further include a holding plate having a supporting axle for rotatably supporting the blade chip via the vibration plate.

According to an embodiment of the present invention, the vibration plate may be set with a plate thickness which is thinner than that of the rubber plate member and that of the reinforcing plate member.

According to an embodiment of the present invention, one or more notches may be formed in a portion of the vibration plate other than a portion of the vibration plate on which the piezoelectric element is disposed.

According to an embodiment of the present invention, the rubber plate member and the reinforcing plate member may be joined together via an intermediary member disposed therebetween.

Other objects and further features of the present invention will become apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 1:
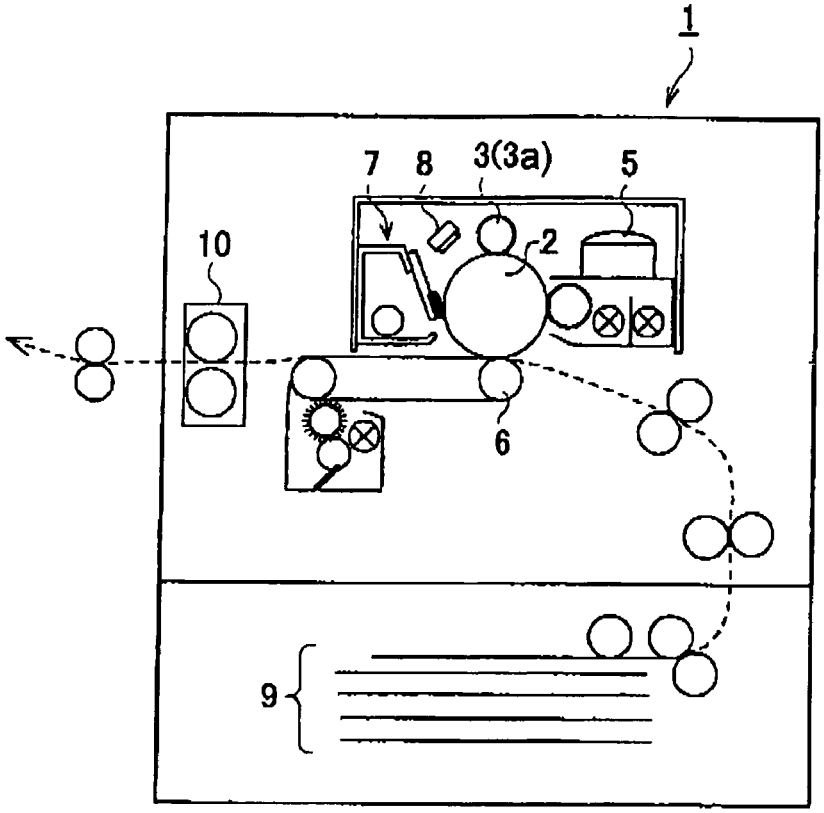
FIG. 1 is a schematic view showing an exemplary entire structure of an image forming apparatus provided with a cleaning apparatus according to a first embodiment of the present invention.

FIG. 1 is a schematic drawing showing an entire structure of an image forming apparatus provided with a cleaning apparatus according to a first embodiment of the present invention.

In an image forming apparatus 1 shown in FIG. 1, a charging apparatus 3 (charging roller 3*a*) which uniformly charges a surface of an image carrier drum (image carrier) 2, an exposing apparatus (not shown) which forms a latent image on the uniformly charged surface of the image carrier drum 2, a developing apparatus 5 which forms a toner image by applying a toner (charged developer) to the latent image on the surface of the image carrier drum 2, a transferring apparatus 6 which transfers the toner image to a recording sheet (not shown) by using, for example, a transfer belt, a transfer roller, or a charger, a cleaning apparatus 7 which removes toner remaining on the image carrier drum 2 after the transfer of the toner image, and a charge removing apparatus 8 which removes electric potential remaining on the image carrier drum 2, are arranged at the periphery of the image carrier drum 2.

In the image carrier drum 2 of the image forming apparatus 1, a latent image is formed by exposure from the exposing apparatus (not shown), and a toner image is formed by the developing apparatus 5. The transfer apparatus 6 transfers the toner image formed on the surface of the image carrier drum 2 to a recording sheet (not shown) conveyed from a sheet-feed tray 9 along a conveyance path (illustrated with a broken line). Then, the toner image transferred onto the recording sheet is fixed to the recording sheet by the fixing apparatus 10. The toner remaining on the image carrier drum 2 is collected by the cleaning apparatus 7. After the toner remaining on the image carrier drum 2 is removed, the charge removing apparatus 8 neutralizes the remaining charge on the image carrier drum 2, and the charging apparatus 3 charges the image carrier drum 2 to initialize the image carrier drum 2 for the next image forming process.

Figure 2:
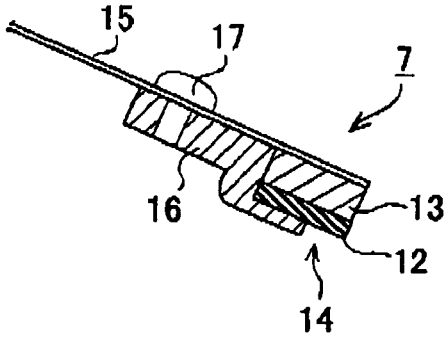
FIG. 2 is a schematic view showing an exemplary entire structure of a cleaning apparatus according to the first embodiment of the present invention.

The cleaning apparatus 7 shown in FIG. 2 includes a blade member 12 which is a rubber plate member having a tip portion disposed toward the image carrier drum 2 for gathering and removing the toner (developer) remaining on the surface of the image carrier drum 2 by making contact against an outer peripheral surface of the image carrier drum 2 after transfer, a blade chip 14 which is formed by joining the blade member (rubber plate member) 12 and a reinforcing plate member (metal plate member) 13 as a united body, a supporting plate 15 which supports the blade chip 14, and a holding plate 16 which is a holder for holding (attaching) the blade chip 14 to the supporting plate 15. It is to be noted that a shank portion of the supporting plate 15 (left side of FIG. 2) is connected to a supporting mechanism (not shown), wherein the supporting mechanism allows the tip portion of the blade member 12 to make contact against the outer peripheral surface of the image carrier drum 2 at a prescribed angle and with a prescribed pressure. Numeral 17 indicates a screw member for maintaining the attached state between the supporting plate 15 and the holding plate 16.

Figure 3:
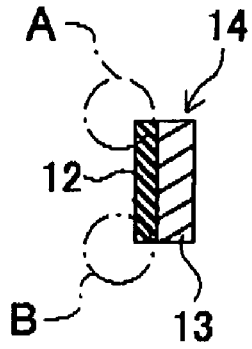
FIG. 3 is a cross-sectional view showing an exemplary blade chip according to the first embodiment of the present invention.

As shown in FIG. 3, the blade chip 14 comprises the blade member 12 which is mainly composed of polyurethane rubber and the reinforcing plate member 13 which is made from, for example, a metal material.

The blade member 12 is formed as a substantially elongated plate with a thickness of, for example, 0.3 mm through 1 mm, and a JISA hardness of, for example, 65 degrees through 90 degrees. The length of the blade member 12 covers, for example, an entire width with respect to the rotational direction of the image carrier drum 2 and/or a development area where an electrostatic latent image is developed on the surface of the image carrier drum 2 by the developing apparatus 5. In a case where, for example, the cleaning apparatus 7 is mounted on an image forming apparatus used as office automation equipment, the length of the blade member 12 is 300 mm through 360 mm.

The conventional blade member is formed with a flexibility for enabling a suitable amount of pressing force to be applied from a tip portion of the blade to the image carrier, so that remaining toner can accumulate at the tip portion, and be removed from the image carrier. In order to achieve such effect, however, the conventional blade member is desired to have a width of 10 mm or more. As the conventional cleaning blade is used for a certain period, the blade member begins to wear, and chips and scratches begin to appear on the edge of the cleaning blade. In these situations, the blade member and a member attached to the blade member are discarded for replacement.

In a cleaning apparatus 7 according to a first embodiment of the present invention, a blade member 12 is joined to a reinforcing plate member 13 formed of metal, to thereby obtain a blade chip 14 which can be handled as an independent member of the cleaning apparatus 7. Accordingly, rigidity can be increased for the blade member 12. In this embodiment, the blade member 12, requiring no other member, can be handled with more ease. Furthermore, the reinforcing plate member 13, formed of metal material, is shaped as an elongated plate having the same length and width as the blade member 12. The reinforcing plate member 13 is provided with a thickness for allowing the blade member 12 to maintain its elongated plate shape, and/or its rigidity. The blade member 12 is provided with at least corner portions A and B as shown in FIG. 3, which are formed having prescribed straight and sharp angles.

The blade chip 14 is symmetrically formed in a vertical direction in FIG. 3, that is, the width direction of the blade chip 14. Therefore, in a case where the corner portion B of the blade chip 14 is worn off, chipped off, and/or scratched, the corner portion A, disposed on the opposite side from corner portion B, can be used as its replacement (alternate) by detaching the pressing plate 16 from the supporting plate 15, then, detaching the blade chip 14, and then, flipping the blade chip 14 upside down. Accordingly, the corner portions of the blade chip 14 can be used at least twice before replacement of the blade chip 14, to thereby expand the longevity of the blade chip 14.

With the cleaning apparatus according to the first embodiment, the blade chip 14 can be easily detached and replaced since the blade member 12 and the reinforcing plate member 13 are joined (e.g. by adhesive attachment), to thereby form a united body, that is, a blade chip. For example, in a case where the blade member 12 has a length 300 mm through 360 mm, a thickness of 0.3 mm through 1 mm, and a width of 10 mm, the blade member 12 of the blade chip 14, even when detached, can maintain its elongated plate structure without being bent or broken since the blade member 12 is joined to the reinforcing plate member 13. Accordingly, the cleaning apparatus can be handled with less care, that is, with more ease. Furthermore, since the shape of the blade chip 14 can be maintained during a procedure of flipping, re-attaching, and/or replacing the blade chip 14, the blade chip 14 can be easily attached.

Furthermore, since a corner portion of the blade member 12, which is situated on a side opposite to the image carrier drum 2, can likewise be employed for providing a blade function, the longevity of the blade member 12 can be extended. That is, even where the end portion (corner portion) of the blade member 12 (e.g. indicated as B in FIG. 3) is used for a certain amount of time, the blade tip 14 can be further used for cleaning by changing the direction for attaching the blade tip 14 to the supporting plate 15 and the holder 16, and allowing an unused end portion (corner portion) of the blade member 12 (e.g. indicated as A in FIG. 3) to be used for cleaning.

Since the unused end portion (corner portion) of the blade tip 14 (e.g. indicated as A in FIG. 3) is disposed at a concave portion formed by the supporting plate 15 and the holding plate 16, the end portion of the blade tip 14 can be protected without having to be exposed to the outside. Thereby, the unused end portion (corner portion) of the blade chip 14 can maintain a sharp straight form. Therefore, by changing the attachment direction of the blade chip 14 and using the unused end portion of the blade chip 14, a sufficient cleaning performance can be further attained. Furthermore, while attaining such cleaning performance, a cost effective benefit can be obtained since the blade part 12 is required to be replaced less frequently.

In attaching the blade chip 14, since the reinforcing plate member 13 and the supporting plate 15 come in face-to-face contact with each other, the blade chip 14 can be stably and firmly attached. Furthermore, the supporting plate 15 enables the blade chip 14 to maintain such position. Furthermore, since both the reinforcing plate member 13 and the supporting plate 15 are formed, for example, of metal material, the blade chip 14 can obtain sufficient strength (rigidity). Accordingly, a tip portion of the blade member 12, after a transfer process, can precisely abut against the image carrier drum 2 at a prescribed angle and with a prescribed abutting pressure. As a result, the blade member 12 is able to perform a sufficient and stable cleaning function.

Next, a second embodiment of the present invention is described. It is to be noted that like components are denoted with like reference numerals as of the first embodiment and are not further described.

Figure 4:
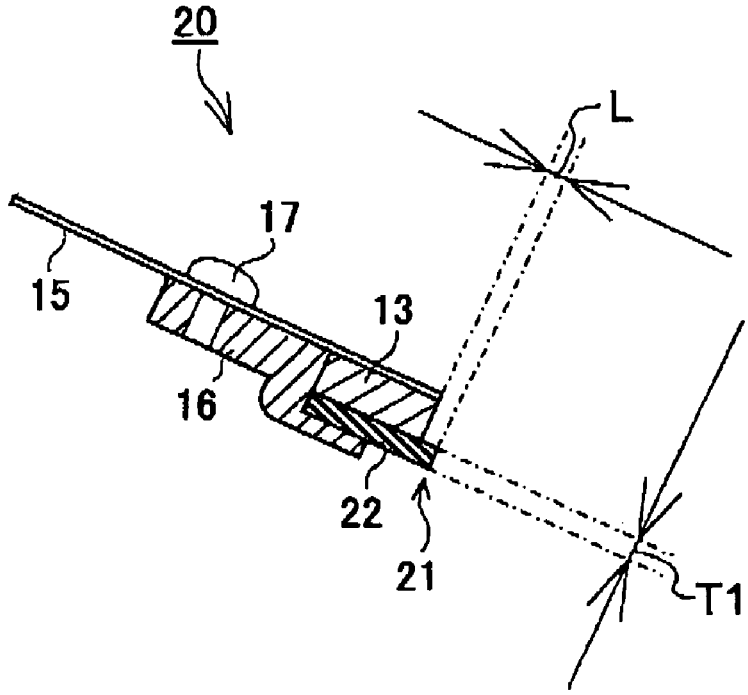
FIG. 4 is a cross-sectional view showing an exemplary cleaning apparatus according to a second embodiment of the present invention.

In a cleaning apparatus according to a second embodiment of the present invention, cleaning performance is further improved by setting the projection of the blade member 22 from the supporting plate 15 of a blade chip 21 to the outside in a width direction (distance from the distal end of the supporting plate 15 of a blade chip 21 to the distal end of the blade member 22) to a prescribed degree (See FIG. 4).

That is, in cleaning the image carrier drum 2, the blade member 22, serving as a cleaning member, is required to have a function of blocking the toner remaining on the image carrier drum 2. The blockage, which is created by abutting a tip portion of the blade member 22 against the image carrier drum 2, is determined by the degree of hardness (e.g. degree of hardness of rubber) of the blade member 22 and the force of the tip portion of the blade member 22 abutting against the image carrier drum 2. Therefore, in a case where the blade member 22 does not project beyond the distal end of the reinforcing plate member 13 (disposed more or less inward with respect to the reinforcing plate member 13 in a width direction), there will be no lack of rigidity and a sufficient abutting force can be maintained since the reinforcing plate member 13 is able to support the entire rear face of the blade member 22 against the force generated by the blade member 22 abutting against the image carrier drum 2. Meanwhile, in a case where the blade member 22 projects beyond the distal end of the reinforcing plate member 13 (disposed more or less outward with respect to the reinforcing plate member 13 in a width direction), as described in this second embodiment, the blockage function of the blade member 22 may be reduced. That is, since the projecting portion of the blade member 22 cannot be supported by the reinforcing plate member 13, the rigidity at the projecting portion decreases. As a result, the force of the tip portion of the blade member 22 abutting against the image carrier drum 22 decreases, and thereby reduces cleaning performance.

Figure 5:
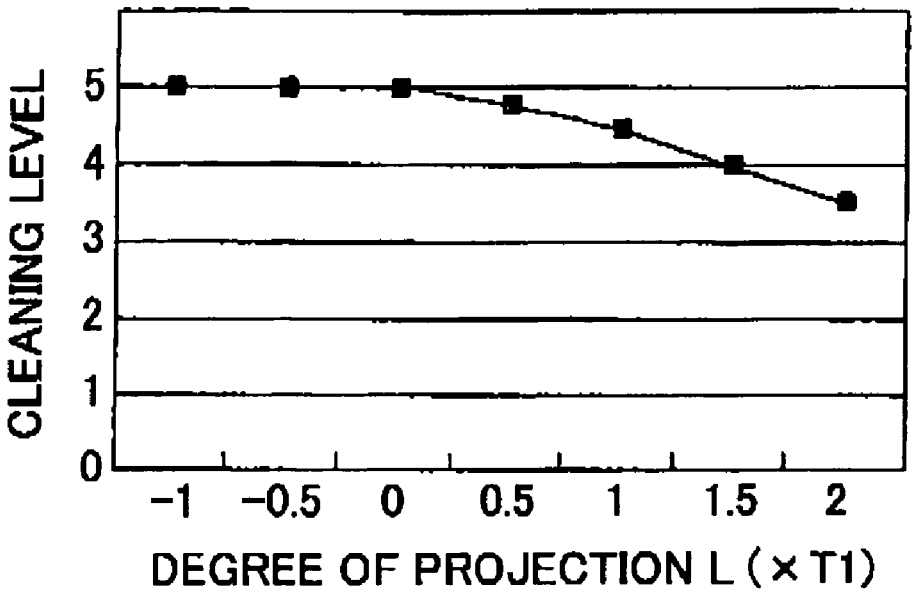
FIG. 5 is a graph showing a relation between degree of projection and cleaning level according to the second embodiment of the present invention.

Here, cleaning performance was graded and categorized into five levels by cleaning the image carrier drum 2 with the blade member 22 while altering the proportion between the degree of projection (L) and the thickness of the blade member (T1). According to the cleaning results as shown in FIG. 5, the resultant relation between the degree of projection of the blade member 22 and cleaning performance shows that cleaning performance becomes lower as the degree of projection L increases. Therefore, in a case where no proportional relation between the degree of projection (L) of the blade member 22 and the thickness (T1) of the blade member 22 is satisfied, that is, where the degree of projection (L) is 0, the cleaning level is graded as the highest level of 5, as indicated by the scale corresponding to 0 on the horizontal axis in FIG. 5. In a case where the degree of projection (L) is the same as the thickness (T1) of the blade member 22, the cleaning level is graded as being in-between level 4 and level 5, as indicated by the scale corresponding to 1 on the horizontal axis in FIG. 5. More particularly, according to the results, it is found that cleaning performance decreases considerably because the rigidity (e.g. rigidity of rubber) becomes smaller and forming the blockage becomes more difficult when the degree of projection (L) is equal to or more than the thickness (T1) of the blade member 22. In addition, it is found that problems, such as curling up of the blade, tend to occur when the degree of projection (L) becomes excessively large.

Therefore, the blade chip 21 according to the second embodiment of the present invention is provided with the blade member 22 having an entire face thereof bonded to the entire face of the reinforcing plate member 13 and having a degree of projection that is 0 or no more than the thickness T1 of the blade member 22. That is, according to the second embodiment of the present invention, the degree of projection L of the blade member 22 is set to be the same as the thickness (T1) of the blade member 22 as shown in FIG. 4.

In the cleaning apparatus 20 according to the second embodiment of the present invention, since the blade chip 21 has a blade member 22 projecting to a prescribed degree in a width direction from the reinforcing plate member 13 toward the image carrier drum 2, reliable cleaning performance can be attained. That is, the degree of projection L is set to be no more than the thickness (T1) of the blade member 22, to thereby provide rigidity (rubber rigidity) for enabling the blade chip 21 (blade member 22) to sufficiently block the toner remaining on the image carrier drum 2.

Next, a third embodiment of the present invention is described with reference to FIG. 6. In a cleaning apparatus 25 according to the third embodiment of the present invention, a piezoelectric element serving as a vibration source for applying vibration to the blade chip 21 (blade member 22) is provided in addition to the components described in the second embodiment. It is to be noted that like components are denoted with like reference numerals as of the second embodiment and are not further described.

Figure 6:
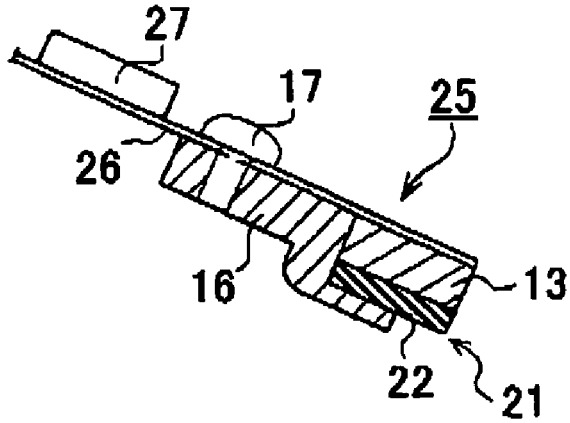
FIG. 6 is a cross-sectional view showing an exemplary cleaning apparatus according to a third embodiment of the present invention.

As shown in FIG. 6, a vibration plate 26, employed as an alternative to the supporting plate 15, abuts against the blade chip 21, and a piezoelectric element 27 is adhesively bonded at a proximal end of the vibration plate 26 (left side of FIG. 6). Preferably, the vibration plate 26, for example, is provided with the same width and length as the supporting plate 15, is formed from a SUS (stainless steel) type spring material, and is formed as an easy-to-vibrate member having a thickness of 0.2 mm to 0.5 mm.

The piezoelectric element 27 is supplied with a repetitive voltage, that is, a periodically repetitively changing voltage with a prescribed voltage variation, to thereby generate a vibration wave from the vibration plate disposed at the proximal end (base end) of the vibration plate 26. The vibration wave vibrates the vibration plate 26 and thus vibrates the blade chip 21 disposed on the distal end of the vibration plate 26. Problems, such as returning of the toner back onto the image carrier drum 2, and/or curling up of the blade edge, can be prevented since the vibration allows the blade member 22, which is an elastic member, to change shape (deform). Accordingly, toner can be prevented from being caught in and passing around the blade member 22. Furthermore, the vibration is effective for separating the toner remaining on the image carrier drum 2 since the vibration is also passed on to the toner remaining on the image carrier drum 2. Accordingly, the blade edge is able to easily perform scraping (picking up) of remaining toner, and thereby enhance cleaning performance.

Figure 7:
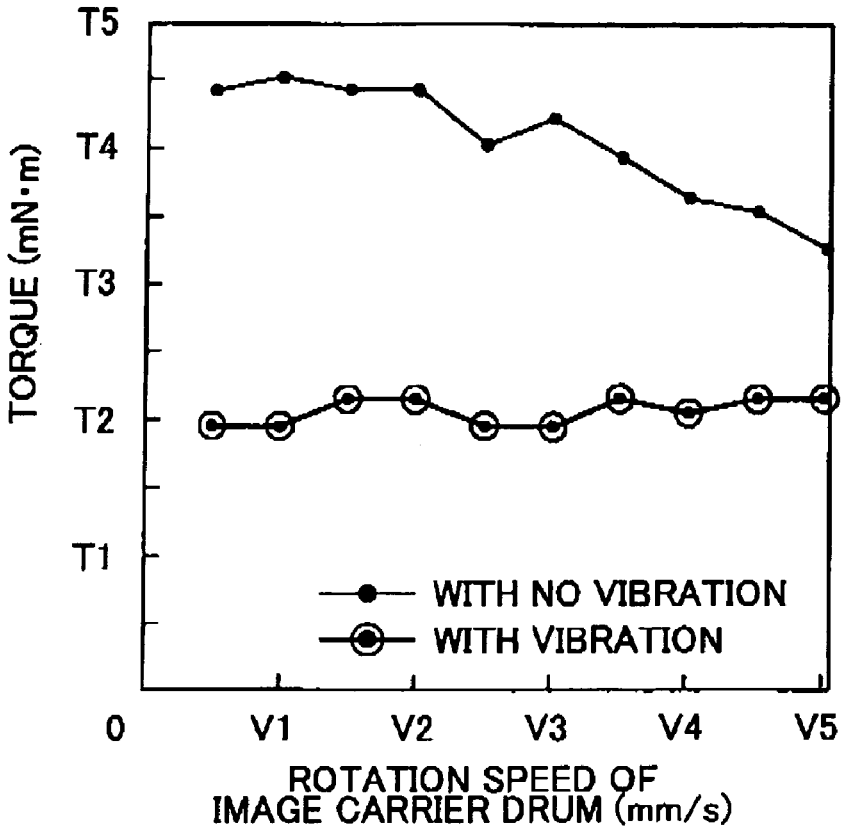
FIG. 7 is a graph showing changes of torque rotation of an image carrier drum in a case where a blade member is applied with and without vibration.

Furthermore, the vibration reduces the friction between the blade edge and the image carrier drum 2, to thereby reduce the frictional force of the sliding contact upon the blade member 22. Here the rotational torque of the image carrier drum 2 was measured in a case where the blade member 22 is applied with and without vibration. According to the results shown in FIG. 7, it is found that in a case where vibration is applied to the blade member 22, the rotational torque of the image carrier drum 2 is approximately 30 to 50% lower compared to a case where no vibration is applied to the blade member 22. Furthermore, as shown in FIG. 7, the rotational torque when a vibration is applied has a tendency of gradually increasing as the rotational speed of the image carrier drum increases from 0 to V5. The rotational torque when no vibration is applied has a tendency of decreasing from T5 to the proximity of T3, but will not decrease to the level of the rotational torque of the blade member applied with vibration. That is, it is found that a significantly reduced rotational torque can be obtained by applying vibration to the blade member 22 even when the image carrier drum 2 is rotated at maximum speed V5. This is due to the fact that the torque load from the friction generated between the blade member 22 and the image carrier drum 2 is reduced. Accordingly, it is found that the longevity of the blade member (blade chip) can be expanded considerably by applying a vibration to the blade member. That is, since frictional force can be reduced in such manner, the wear of the blade member 22 caused by frictional force can be reduced.

With the cleaning apparatus 25 according to the third embodiment of the present invention, the frictional force generated between the blade member 22 and the image carrier drum 2 can be reduced by applying vibration to the blade chip 21 (blade member 22). Accordingly, the wear of the blade member 22 as well as that of the image carrier drum 2 can be reduced, to thereby expand its longevity. Furthermore, since frictional force is reduced in such manner, the curling of the blade (member) can be prevented. Therefore, the blade edge (distal end shape of the blade member 22) can be prevented from being deformed. Accordingly, the blade member 22 is able to steadily provide a satisfactory cleaning performance. Furthermore, the image carrier drum 2 can be rotatively driven steadily since the frictional load applied to the image carrier drum 2 is reduced. Accordingly, image forming operations that are associated with the rotation of the image carrier drum 2 can also be performed steadily. As a result, image quality can be improved.

Next, a fourth embodiment of the present invention is described with reference to FIG. 8. In a blade member 32 of a blade chip 31 of a cleaning apparatus 30 according to the fourth embodiment of the present invention, a portion of the blade member 32 that makes contact with the image carrier drum 2 (not shown) is partly or entirely subjected to modification processing (including surface processing) so that the frictional coefficient at the contacting portion is reduced. It is to be noted that like components are denoted with like reference numerals as of the second embodiment and are not further described.

Figure 8:
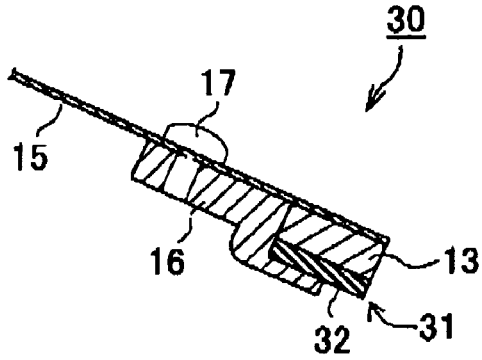
FIG. 8 is a cross-sectional view showing an exemplary cleaning apparatus according to a fourth embodiment of the present invention.

That is, at least the contacting portions of the blade member 32 (lower left and lower right portions of the blade member 32 in FIG. 8). More particularly, the blade edge portion A and the blade edge portion B (FIG. 3) are partly or entirely subjected to modification (surface processing). As a conventional example of surface processing for reducing the frictional coefficient, there is a technique (method) of coating with an activated powder of graphite or molybdenum disulfide. However, such coating technique has a problem of poor endurance in which the coated activated powder peels along with the passing of time.

Therefore, according to the fourth embodiment of the present invention, the contacting portion of the blade member 32 is halogenated (halogen processed), more particularly, chlorinated (chlorination) by adding chlorine to a double-bond part of rubber molecules and modifying the material of the blade member 32. That is, the blade member 32 is laid in a chlorine gas environment of a prescribed concentration for a prescribed amount of time.

Here, in order to test the results of the modification, changes of frictional coefficient of the blade member 32 were measured, beginning from the chlorination process, in prescribed intervals under a fixed gaseous chlorine concentration of 50 volume %. According to the test results, a frictional coefficient of $\mu=2$ for a target process portion (unprocessed contacting portion) of the blade member 32 is reduced to $\mu=0.5$ after processing the target process portion for 10 minutes. Accordingly, the wear of the contacting portion of the blade member 32 can be reduced, and the longevity of the blade chip 31 can be expanded.

With the cleaning apparatus 30 according to the fourth embodiment of the present invention, since the frictional coefficient of the surface of a prescribed portion of the blade member 32 of the blade chip 31 can be reduced by modification (surface treating) of the prescribed portion, the frictional force generated from the contact between the blade member 32 and the image carrier drum 2 can be reduced, and the longevity of the blade member 32 (blade chip 31) can be expanded. That is, in the cleaning apparatus 30 according to the fourth embodiment of the present invention, instead of newly adding another material (friction reducing material) onto the surface of the blade member 32 for reducing friction force, the material of the blade member 32 itself, at least for a portion contacting the image carrier drum 2, is subjected to modification for reducing frictional force generated at the portion contacting the image carrier drum 2. Therefore, the blade member 32 will not encounter a problem of endurance wherein a friction reducing material is peeled off with the passing of time, as with, for example, the conventional coating technique.

Furthermore, since the modification process is performed by placing the blade member 32 in a gas environment, instead of directly applying a solid material onto the blade member 32, the shape of the blade edge of the blade member 32 will not be adversely affected by performing the modification process. Therefore, frictional force can be reduced while still obtaining a precise blade edge shape, to thereby enhance cleaning performance.

Next, a fifth embodiment of the present invention is described with reference to FIG. 9. With a cleaning apparatus 35 according to the fifth embodiment of the present invention, the blade chip 21 is rotatable in a contacting-separating direction with respect to the image carrier drum 2, and is able to urge (exert force) against the image carrier drum 2 in a contacting direction. It is to be noted that like components are denoted with like reference numerals as of the second embodiment and are not further described.

In a case where a blade chip having a highly rigid blade member 22 is used, unlike a conventional cleaning blade, it becomes difficult to cause the distal end of the blade member 22 to dig, approximately 1 mm, into the image carrier drum 2. It is desired for the distal end of the blade member 22 to dig into the image carrier drum 2 to such a degree (amount) so that the fluctuation in the straightness of the blade member 22 itself, and/or variation in the vibration of the image carrier drum 2 during rotation can be absorbed.

Figure 9:
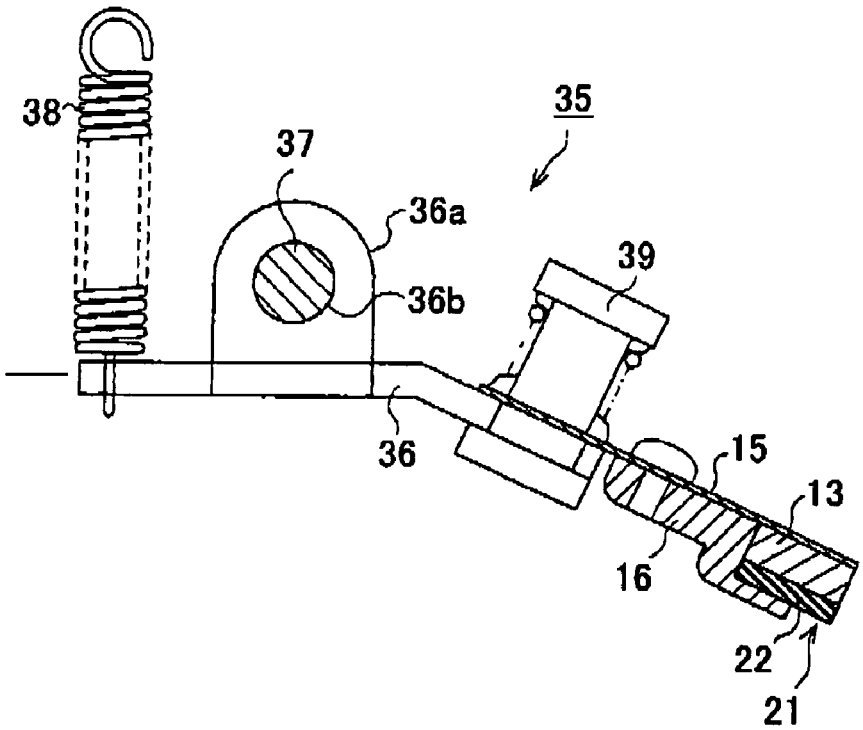
FIG. 9 is a cross-sectional view showing an exemplary cleaning apparatus according to a fifth embodiment of the present invention.

In the cleaning apparatus 35 shown in FIG. 9, a holding plate 36, having a prescribed shape, is connected to the distal end of the supporting plate 15 (right side of FIG. 9), and is axially supported by a horizontally disposed support axle 37. With this structure, the blade chip 21 is supported in a rotatable manner. That is, a rib portion 36*a* is integrally disposed at a substantially center portion of the holding plate 36 in a manner projecting in a direction perpendicular to the extending direction of the holding plate 36, that is, the vertical direction in FIG. 9. An axle aperture 36*b* with a prescribed diameter is disposed at a substantially center of the rib portion 36*a*. The support axle 37, which is attached to a fixed member such as a casing (not shown) situated toward the side of the cleaning apparatus 35, is inserted into and rotationally engaged by the axle aperture 36*b*.

Furthermore, the holding plate 36, having the support axle 37 as its center, is urged by a spring (urging member) 38, so that the distal end portion of the blade member 22 constantly abuts against the image carrier drum 2 with a prescribed force. That is, the spring 38 is a spring member in a stretched (tensioned) state, in which one end thereof is fixed to a member situated toward the side of the cleaning apparatus 35, and the other end thereof is connected to the proximal end of the holding plate 36. Accordingly, the pulling force of the spring 38 transmitted to the proximal end side of the holding plate 36 allows the proximal end of the holding plate 36 to be urged in the upward direction of FIG. 9, and allows the holding plate 36 to rotate clockwise with the support axle 37 as the rotational axis. As a result, the blade member 22 constantly abuts against the image carrier drum 2. Therefore, error causing factors (e.g. changes in the shape of the components, changes in the assembly of the components, changes in the movement of the components) can be attended to. That is, even when such changes occur, the blade edge is able to follow such changes since the blade member 22 is rotatably urged against the image carrier drum 2. Accordingly, a state where the blade edge constantly abuts against the outer peripheral surface of the image carrier drum 2 can be maintained.

It is to be noted that numeral 39 is an axial member which rotationally connects the holding plate 36 and the supporting plate 15 and which also allows the surface of the blade member 22 to rotate as a rotating surface relative to the holding plate 36. By enabling the supporting plate 15 to rotate via the axial member 39, even where the relative position between the blade member 22 and the image carrier drum 2 is changed, the parallel arrangement between the blade edge of the blade member 22 and the outer surface of the image carrier drum 2 can be maintained. Accordingly, the blade edge of the blade member 22 can satisfactorily maintain contact with the image carrier drum 2, to thereby provide a steady cleaning performance.

In the cleaning apparatus 35 according to the fifth embodiment of the present invention, the distal end (blade edge) of the blade member 22 is able to uniformly maintain contact (abut) against the outer peripheral surface of the image carrier drum 2 since the holding plate 36 is provided with the support axle 37 for rotatably supporting the blade chip 21 (blade member 22). Accordingly, cleaning can be performed evenly. Furthermore, since various changes due to error in shape, assembly, and movement can be attended to, components need not be formed with high precision (thereby reducing manufacturing cost), and/or inspection after assembly can be simplified (thereby reducing assembly cost), for example.

Next, a sixth embodiment of the present invention is described with reference to FIG. 10. In a cleaning apparatus 40 according to the sixth embodiment of the present invention, a vibration plate 41 is set with a plate thickness which is less than that of the reinforcing plate member 13 and that of the blade member 22, to thereby allow the vibration generated from the piezoelectric element 27 to easily propagate to the blade member 22. It is to be noted that like components are denoted with like reference numerals as of the third embodiment and are not further described.

Figure 10:
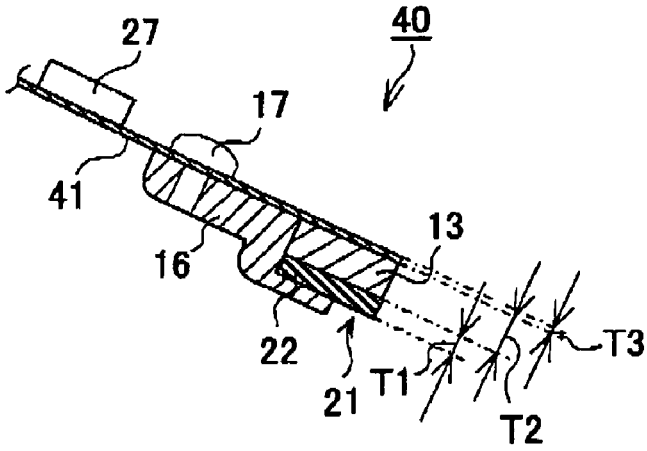
FIG. 10 is a cross-sectional view showing an exemplary cleaning apparatus according to a sixth embodiment of the present invention.

In the cleaning apparatus shown in FIG. 10, the relation of the thickness as for the vibration plate 41, the reinforcing plate member 13, and the blade member 22 is set to satisfy T3<T1 and T3<T2, wherein T1 indicates the thickness of the blade member 22, T2 indicates the thickness of the reinforcing plate member 13, and T3 indicates the thickness of the vibration plate 41. Therefore, the vibration plate 41 is easier to flex compared to the reinforcing plate member 13 and the blade member 22. This allows vibration propagated to the vibration plate 41 to easily propagate to the blade member 22 via the reinforcing plate member 13. As a result vibration can be applied more efficiently. It is to be noted that measurements (except for thickness) and material of the vibration plate 41 are the same as the above-described vibration plate 26.

Accordingly, with the cleaning apparatus 40 according to the sixth embodiment of the present invention, vibration can be satisfactorily propagated by setting the thickness of the vibration plate thinner than that of the reinforcing plate member 13, and that of the blade member 22. That is, since the vibration plate 41 is allowed to easily change shape by setting the thickness of the vibration plate less than that of the reinforcing plate member 13 and that of the blade member 22, vibration energy consumed in the changing of shape can be reduced, thereby enabling vibrations to be propagated more effectively and efficiently. Accordingly, the vibrations from the piezoelectric element 27 can be efficiently propagated to the blade member 22. As a result, the energy consumed by the piezoelectric element 27, (vibration source) can be reduced. Accordingly, energy can be saved. Furthermore, since the vibration output of the piezoelectric element 27 can be reduced, the piezoelectric element 27 can be formed with less size and weight. Furthermore, manufacturing cost, for example, can be reduced since the output of the piezoelectric element 27 can be reduced.

Figure 11:
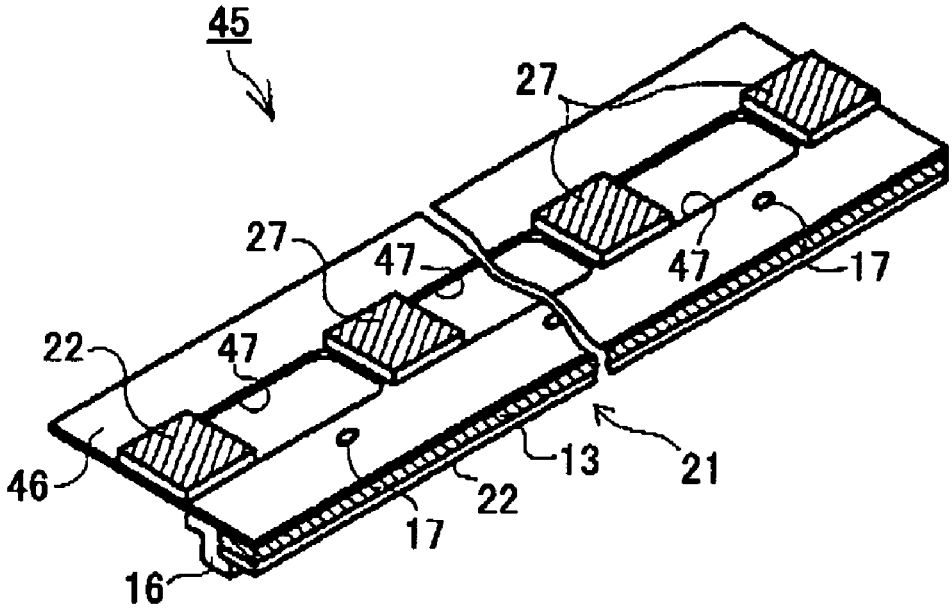
FIG. 11 is a perspective view showing an exemplary blade chip and a vibration plate of a cleaning apparatus according to a seventh embodiment of the present invention.

Next, a seventh embodiment of the present invention is described with reference to FIG. 11. In a cleaning apparatus 45 according to the seventh embodiment of the present invention, notches are suitably disposed at prescribed portion of the vibration plate 46 for further improving the vibration property. It is to be noted that like components are denoted with like reference numerals as of the sixth embodiment and are not further described.

In the cleaning apparatus 45, notch portions 47, which are formed by notching the vibration plate 46 into substantially rectangular shapes, are disposed between the vibration plates 46 in a direction where a plurality of piezoelectric elements 27 are aligned in a longitudinal direction of the vibration plate 46. Accordingly, by reducing the section modulus of the vibration plate 46 serving as a beam, a more flexible structure is obtained. That is, since the piezoelectric elements 27 of the vibration plate 46 are disposed as abridge-like beam extending from the proximal end to the distal end of the vibration plate 46, the section modulus is reduced. Therefore, vibrations from the proximal end of the vibration plate 46 can be propagated more efficiently to blade chip 27 disposed at the distal end of the vibration plate 46.

As exemplary processing methods for forming the notched vibration plate 46, it is desired to employ a method which applies little or no stress to the vibration plate 46 for removal (notching), and which accumulates little or no internal stress, for example, press working, etch processing, laser processing, and wire-cut processing.

With the cleaning apparatus 45 according to the seventh embodiment of the present invention, the vibration plate 46 becomes easier to bend and vibrate by forming notches in portions of the vibration plate 46. Therefore, kinetic energy required for vibrating the vibration plate 46 can be reduced. Therefore the energy consumption (drive voltage) of the piezoelectric elements 27 can be reduced, to thereby save power.

It is to be noted that although the seventh embodiment of the present invention describes the notch portions 47 being provided on the inner surface of the vibration plate 46, the notch portion 47 may be provided in a manner extending to the peripheral rim of the vibration plate 46, or provided on one or both sides of the vibration plate.

Figure 12:
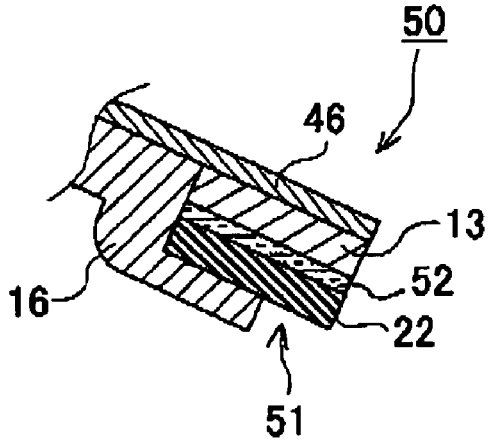
FIG. 12 is a cross-sectional view showing an exemplary cleaning apparatus according to an eighth embodiment of the present invention.

Next, the eight embodiment of the present invention is described with reference to FIG. 12. In a cleaning apparatus 50 according to the eighth embodiment of the present invention, an intermediary member is disposed between the reinforcing plate member 13 and the blade member 22 for improving the vibration attenuation property of the blade chip 51. It is to be noted that like components are denoted with like reference numerals as of the seventh embodiment and are not further described.

As described above, taking factors such as vibration propagation and flexibility into account, a metal material is, for example, employed as the material of the vibration plate 46. Furthermore, taking factors such as shape stability and endurance against the environment into account, a polyurethane rubber is, for example, employed as the material of the blade member 22.

In a case where vibration is propagated from the vibration plate 46 (vibration source) to the blade member 22 (e.g., made from synthetic rubber) via the reinforcing plate member 13 (e.g., made of metal material), a large difference in acoustic resistance (pc) is created between the reinforcing plate member 13 and the blade member 22. Accordingly, a vibration is attenuated considerably when vibration is propagated from the reinforcing plate member 13 having a large acoustic resistance to the blade member 22 having a small acoustic resistance. Here, p indicates density, and c indicates acoustic resistance of material. In a conventional example, the value of acoustic resistance ($g/s/cm^2$) of the reinforcing plate member 13 and the blade member 22 are indicated as below.

Reinforcing plate member 13 (iron): $270\times10^4$ ($g/s/cm^2$)

Blade member 22 (synthetic rubber): $1.4\times10^4$ ($g/s/cm^2$)

Accordingly, in the above-given conventional example, a ratio of approximately 190 exists between the acoustic resistance value of the reinforcing plate member 13 and that of the blade member 22. According to the eighth embodiment of the present invention as shown in FIG. 12, by disposing an intermediary member 52, such as a synthetic resin material (e.g. polyethyleneterephthalate having an acoustic resistance of $44\times10^4$) between the reinforcing plate member 13 and the blade member 22, the ratio between the supporting member plate 13 and the intermediary member 52, in comparison with the ratio of the conventional example of approximately 190, can be reduced considerably to 6. Accordingly, attenuation of vibration when propagating vibration from the reinforcing plate member 13 to the intermediary member 52 will be small, and thus, attenuation of vibration when propagating vibration from the intermediary member 52 to the blade member 22 will be small. As a result, vibration can be propagated more efficiently.

With the cleaning apparatus 50 according to the eighth embodiment of the present invention, the vibration propagated from the reinforcing plate member 13 to the blade member 22 can be prevented from being attenuated (decreasing). Therefore, kinetic energy required for vibrating the vibration plate 46 can be reduced. Therefore, energy consumption (drive voltage) of the piezoelectric elements 27 can be reduced, to thereby save power.

Figure 13:
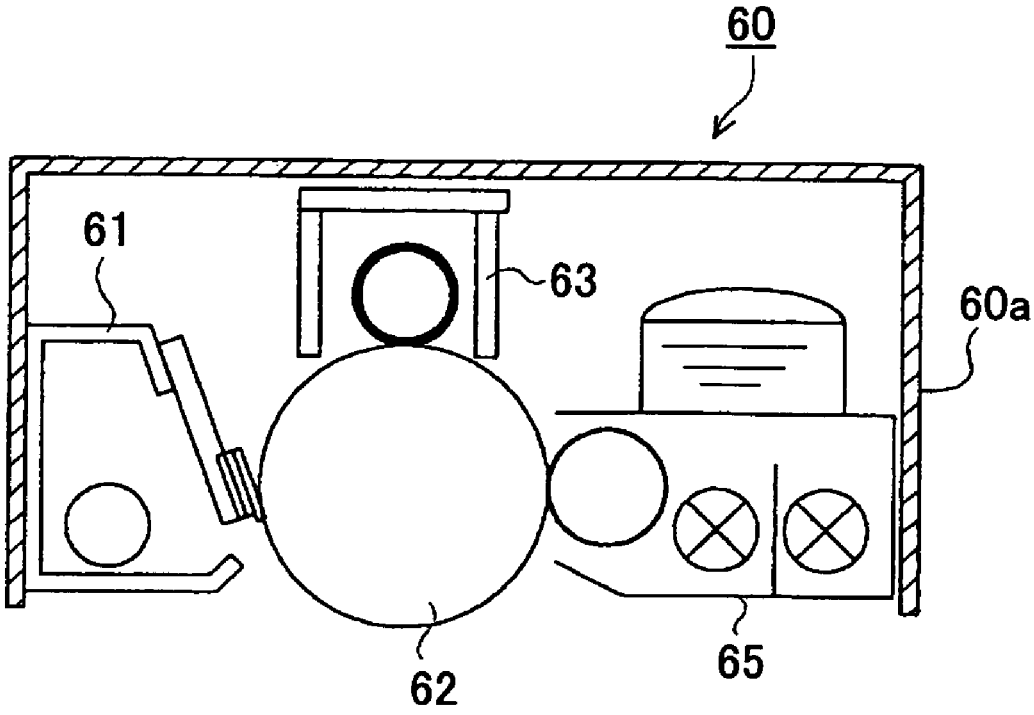
FIG. 13 is a schematic view showing an exemplary process cartridge according to a ninth embodiment of the present invention.

Next, a ninth embodiment of the present invention is described with reference to FIG. 13. In the ninth embodiment of the present invention, a process cartridge (engine cartridge) 60 is provided as a united body having a prescribed cartridge case 60*a* installed with an image carrier drum 62 (image carrier) and a cleaning apparatus 61 for cleaning the image carrier drum 62.

The ninth embodiment of the present invention provides a process cartridge structure (process cartridge 60) having the cartridge case 60*a* installed and thus forming a united body with the cleaning apparatus 61 corresponding to any one of the cleaning apparatuses 7, 20, 25, 30, 35, 40, and 50 described in the first embodiment through the eighth embodiment, the image carrier drum 62, a charging unit 63 for charging the image carrier drum 62, and a developing unit 65 for developing an electrostatic image formed on the image carrier drum 62 with toner (developer). The process cartridge 60 is detachably attached to an image forming apparatus (not shown).

With the ninth embodiment, by employing the process cartridge (engine cartridge) 60 that forms a united body with the above-listed components including the cleaning apparatus 61, a compact-sized image forming apparatus can be obtained, and the process cartridge can be detached and replaced with ease.

Figure 14:
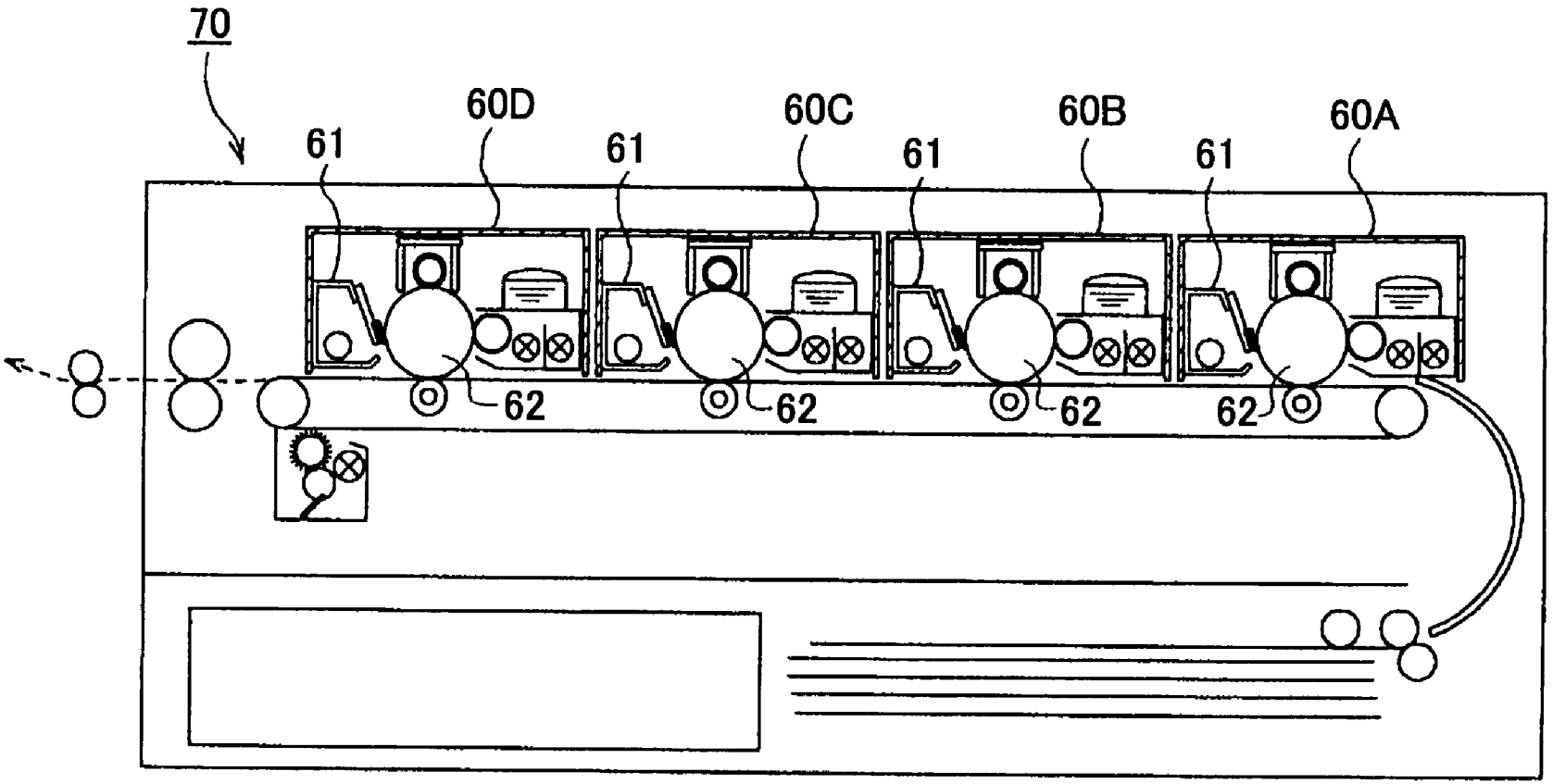
FIG. 14 is a schematic view showing an exemplary entire structure of an image forming apparatus including a plurality of process cartridges according to a tenth embodiment of the present invention.

Next, a tenth embodiment of the present invention is described with reference to the FIG. 14. With an image forming apparatus 70 according to the tenth embodiment of the present invention as shown in FIG. 14, process cartridges 60A through 60D corresponding to different colors are employed. It is to be noted that like components are denoted with like reference numerals as of the ninth embodiment and are not further described.

Multiple process cartridges 60A through 60D, each of which includes a cleaning apparatus 61, are mounted on the image forming apparatus 70 as shown in FIG. 14. For example, the process cartridges 60A through 60D, respectively corresponding to Magenta, Cyan, Yellow, and Black, are detachably attached to the image forming apparatus 70 and are disposed from the right side to the left side of FIG. 14.

With the tenth embodiment of the present invention, a compact-sized image forming apparatus can be obtained, and the process cartridges can be detached and replaced with ease, especially for a color image forming apparatus in which each of the process cartridges corresponds to a different color.

It is to be noted that although the cleaning apparatus (blade chip) of the present invention according to the above-described embodiments is applied for removing toner (developer) remaining on an image carrier (e.g. image carrier drum (photoconductor) 2, 62), it may also be applied to other apparatuses. For example, the cleaning apparatus (blade chip) of the present invention according to the above-described embodiments may be employed as a cleaning apparatus for a charge roller, a transfer roller, and/or an intermediary transfer belt of a process cartridge, and or an image forming apparatus.

Furthermore, it is to be noted that the metal plate member is described as one example of the reinforcing plate member in the foregoing embodiments. The reinforcing plate member of the present invention is not to be limited to a plate member made of metal material. That is, it is apparent that the advantages of the present invention can be attained by substituting the material of the reinforcing plate member with a material having a Young's modulus larger than that of the material of the rubber plate member (e.g. hard rubber, plastic).

In consequence, according to the foregoing embodiment of the present invention, since a cleaning apparatus is provided with a blade chip having a rubber plate member (blade member) and a reinforcing plate member (metal plate member) that are joined together to form a united body, the blade chip can easily be detached and replaced as an independent component. Furthermore, since the edge portion disposed on the side opposite to the side facing the image carrier can also serve to provide a cleaning function, the longevity of the cleaning blade (blade member) is longer than the conventional cleaning blade.

Furthermore, according to the foregoing embodiment of the present invention, since the length between a distal end of the rubber plate member and a distal end of the metal plate member (reinforcing plate member) (degree of projection) is set with a prescribed length (distance), a reliable cleaning performance can be attained.

Furthermore, according to the foregoing embodiment of the present invention, since frictional force between the rubber plate member and the image carrier can be reduced by applying vibration to the rubber plate member, the wear of the rubber plate member and the image carrier can be reduced, thereby extending the longevity of the rubber plate member and the image carrier. In addition, since the turning over of the blade can be prevented, deformation of the distal end of the blade member can be prevented, thereby resulting in an improved cleaning performance.

Furthermore, according to the foregoing embodiment of the present invention, since the rubber plate member is surface treated, the frictional force created thereat can be reduced, the longevity of the rubber plate member can be extended.

Furthermore, according to the foregoing embodiment of the present invention, since a holding plate having a support axle for rotatably supporting the blade chip is provided, the distal end (edge) of the rubber plate member can uniformly make contact against the outer peripheral surface of the image carrier. Thereby, cleaning can be performed evenly.

Furthermore, according to the foregoing embodiment of the present invention, since the vibration plate is set with a plate thickness which is less than that of the rubber plate member and that of the metal plate member (reinforcing plate member), propagation of vibration can be improved. Thereby, energy consumption (driving voltage) of the piezoelectric element can be reduced and saved.

Furthermore, according to the foregoing embodiment of the present invention, since one or more notches are formed in a portion of the vibration plate, the vibration plate is allowed to easily change shape and vibrate. Therefore, kinetic energy for vibrating the vibration plate can be reduced. Accordingly, energy consumption (driving voltage) of the piezoelectric element can be reduced and saved.

Furthermore, according to the foregoing embodiment of the present invention, since the intermediary member is disposed between the rubber plate member and the metal plate member (reinforcing plate member), efficiency in vibration propagation can be prevented from degrading. That is, since vibration is transmitted from the metal plate member (reinforcing plate member) to the intermediary member, and is then transmitted from the intermediary member to the rubber plate member, attenuation of vibration is small compared to directly transmitting vibration from the metal plate member (reinforcing plate member) to the rubber plate member.

Furthermore, according to the foregoing embodiment of the present invention, since an image forming apparatus is provided with the cleaning apparatus, a compact-sized image forming apparatus can be obtained, and the process cartridges can be detached and replaced with ease.

Furthermore, according to the foregoing embodiment of the present invention, since respective components are provided to the process cartridge as a united body, a compact-sized image forming apparatus can be obtained, and the process cartridges can be detached and replaced with ease.

Furthermore, according to the foregoing embodiment of the present invention, since a plurality of process cartridges are provided to the image forming apparatus, a compact-sized image forming apparatus can be obtained, and the process cartridges can be detached and replaced with ease, especially for a color image forming apparatus in which each of the process cartridges corresponds to a different color.

The present application is based on Japanese Priority Application No. 2003-113506 filed on Apr. 17, 2003, with the Japanese Patent Office, the entire contents of which are hereby incorporated by reference.

The invention claimed is:

1. A cleaning apparatus comprising:

a blade chip having a rubber plate member and a reinforcing plate member that are joined together;

a supporting plate supporting the blade chip; and a holder pressing the blade chip against the supporting plate;

wherein the reinforcing plate member has first and second end planes, wherein when the blade chip is in an original position, the first end plane is located a predetermined distance from the distal end of the supporting plate, and wherein when the blade chip is in a changed position, the second end plane is located at the predetermined distance from the distal end of the supporting plate.

2. The cleaning apparatus as claimed in claim 1, wherein the length between a distal end of the rubber plate member and a distal end of the reinforcing plate member is no more than the thickness of the rubber plate member.

3. The cleaning apparatus as claimed in claim 1, wherein at least a portion of the rubber plate member is surface treated for reducing friction created thereon.

4. The cleaning apparatus as claimed in claim 1, further comprising a holding plate having a support axle for rotatably supporting the blade chip via the supporting plate.

5. An image forming apparatus comprising:

the cleaning apparatus as claimed in claim 1.

6. A process cartridge having an image carrier on which an electrostatic latent image is formed, a charging unit for charging the image carrier to form the electrostatic latent image thereon, a developing unit for developing the electrostatic latent image with a developer, the process cartridge comprising:

the cleaning apparatus as claimed in claim 1.

7. An image forming apparatus comprising:

at least one process cartridge as claimed in claim 6.

8. A cleaning apparatus comprising:

a blade chip having a rubber plate member and a reinforcing plate member that are joined together;

a vibration plate supporting the blade chip;

a piezoelectric element disposed on the vibration plate for propagating vibration to the blade chip via the vibration plate; and a holder pressing the blade chip against the vibration plate;

wherein the reinforcing plate member has first and second end planes, wherein when the blade chip is in an original position, the first end plane is located a predetermined distance from the distal end of the vibration plate, and wherein when the blade chip is in a changed position, the second end plane is located at the predetermined distance from the distal end of the vibration plate.

9. The cleaning apparatus as claimed in claim 8, wherein at least a portion of the rubber plate member is surface treated for reducing friction created thereon.

10. The cleaning apparatus as claimed in claim 8, further comprising a holding plate having a support axle for rotatably supporting the blade chip via the vibration plate.

11. The cleaning apparatus as claimed in claim 8, wherein the vibration plate has a plate thickness which is less than that of the rubber plate member and that of the reinforcing plate member.

12. The cleaning apparatus as claimed in claim 8, wherein one or more notches are formed in a portion of the vibration plate other than a portion of the vibration plate on which the piezoelectric element is disposed.

13. The cleaning apparatus as claimed in claim 8, wherein the rubber plate member and the reinforcing plate member are joined together via an intermediary member disposed therebetween.

14. An image forming apparatus comprising:

the cleaning apparatus as claimed in claim 8.

15. A process cartridge having an image carrier on which an electrostatic latent image is formed, a charging unit for charging the image carrier to form the electrostatic latent image thereon, a developing unit for developing the electrostatic latent image with a developer, the process cartridge comprising:

the cleaning apparatus as claimed in claim 8.

16. An image forming apparatus comprising:

at least one process cartridge as claimed in claim 15.

17. A cleaning apparatus comprising:

a blade chip having a rubber plate member and a reinforcing plate member that are joined together;

a supporting plate supporting the blade chip; and a holder pressing the blade chip against the supporting plate;

wherein the length between a distal end of the rubber plate member and a distal end of the reinforcing plate member is no more than the thickness of the rubber plate member.

18. A cleaning apparatus comprising:

a blade chip having a rubber plate member and a reinforcing plate member that are joined together;

a vibration plate supporting the blade chip;

a piezoelectric element disposed on the vibration plate for propagating vibration to the blade chip via the vibration plate; and a holder pressing the blade chip against the vibration plate;

wherein one or more notches are formed in a portion of the vibration plate other than a portion of the vibration plate on which the piezoelectric element is disposed.

19. A cleaning apparatus comprising:

a blade chip having a rubber plate member and a reinforcing plate member that are joined together;

a vibration plate supporting the blade chip;

a piezoelectric element disposed on the vibration plate for propagating vibration to the blade chip via the vibration plate; and a holder pressing the blade chip against the vibration plate;

wherein the rubber plate member and the reinforcing plate member are joined together via an intermediary member disposed therebetween.

* * * * *